United States Patent [19]

Vidal et al.

[11] Patent Number: 4,690,075

[45] Date of Patent: Sep. 1, 1987

[54] IGNITION AND COMBUSTION SUPPORTING BURNER FOR PULVERIZED SOLID FOSSIL FUEL AND COMBUSTION CHAMBER COMPRISING SAME

[75] Inventors: Jean Vidal, Ville d'Avray; Francois Malaubier, Le Plessis Robinson; Jean-Claude Mevel, Les Ulis, all of France

[73] Assignee: Stein Industrie, Velizy Villacoublay, France

[21] Appl. No.: 891,429

[22] Filed: Aug. 4, 1986

[63] Related U.S. Application Data

Continuation of Ser. No. 766,375, Aug. 16, 1985, abandoned.

[30] Foreign Application Priority Data

Aug. 16, 1984 [FR] France ..... 84 12855

[51] Int. Cl.[4] ..... F23D 1/02

[52] U.S. Cl. ..... 110/264; 110/347; 431/183

[58] Field of Search ..... 431/9, 174, 175, 177, 431/179, 186, 181-183, 187, 189, 190, 351, 353; 110/264, 265, 347

[56] References Cited

U.S. PATENT DOCUMENTS

| | | | |
|---|---|---|---|
| 2,485,656 | 10/1949 | Raskin | 431/187 |
| 3,123,027 | 3/1964 | Livingston | 110/265 |
| 4,173,189 | 11/1979 | Cooper | 110/106 |
| 4,381,718 | 5/1983 | Carver et al. | 110/347 |
| 4,438,707 | 3/1984 | Delaplace et al. | 110/264 |
| 4,523,530 | 6/1985 | Kaminaka et al. | 110/264 |
| 4,531,461 | 7/1985 | Sayler et al. | 110/264 |
| 4,545,307 | 10/1985 | Morita et al. | 110/264 |

FOREIGN PATENT DOCUMENTS

| | | | |
|---|---|---|---|
| 916663 | 8/1954 | Fed. Rep. of Germany | 110/264 |
| 3048201 | 7/1982 | Fed. Rep. of Germany | 110/264 |

*Primary Examiner*—Samuel Scott
*Assistant Examiner*—Noah Kamen
*Attorney, Agent, or Firm*—Sughrue, Mion, Zinn, Macpeak & Seas

[57] ABSTRACT

An ignition and combustion supporting burner for pulverized solid fossil fuel comprises an axial conduit for feeding the pulverized fuel in a primary combustion supporting gas. The shape of a refractory tap-hole enables the initial part of the flame to be confined. A conduit for feeding tertiary combustion supporting gas is concentric with the tap-hole and partially or totally surrounds it. The burner also incorporates a flame detector device and an igniter in the refractory tap-hole or in the axial conduit. The axial conduit is provided with translation means providing for adjustment of the length of a chamber for preliminary mixing of the fuel and part of the combustion supporting gas comprised between the end of this conduit and the inlet of the tap-hole.

2 Claims, 6 Drawing Figures

IGNITION AND COMBUSTION SUPPORTING BURNER FOR PULVERIZED SOLID FOSSIL FUEL AND COMBUSTION CHAMBER COMPRISING SAME

This is a continuation of application Ser. No. 766,375, filed Aug. 16, 1985, now abandoned.

BACKGROUND OF THE INVENTION

1. Field of the Invention

The present invention concerns an ignition and combustion supporting burner for pulverized solid fossil fuel.

2. Description of the Prior Art

Combustion plant for pulverized solid fuels of known boilers for thermal power stations, or possibly furnaces, comprises in addition to the main burners ignition and combustion supporting burners the function of which is to provide for cold starting and to assist the main burners at low loads.

Because of the increasing proportion of electrical power produced by nuclear power stations, pulverized fossil fuel power stations are increasingly called upon to operate on a topping up basis at peak consumption times. This entails frequent starting and prolonged operation at low loads. Ignition and support burners normally use as fuel heavy oil or gas, more expensive than pulverized fossil fuel, so that this mode of operation significantly increases operating costs.

An object of the present invention is to provide an ignition and combustion supporting burner for pulverized fossil fuel which features lower operating costs than a fuel oil or gas ignition and support burner and which readily adapts to frequent stopping and prolonged operation at low load.

SUMMARY OF THE INVENTION

The present invention consists in an ignition and combustion supporting burner for pulverized fossil fuel, comprising an axial conduit for feeding pulverized solid fuel in a primary combustion supporting gas, a refractory tap-hole the shape of which enables the initial part of the flame to be confined, a premix chamber for preliminary mixing of said fuel and part of said combustion supporting gas between the end of said axial conduit and the inlet of said tap-hole, a conduit for feeding tertiary combustion supporting gas concentric with said tap-hole and partially or totally surrounding it, adapted to be supplied with a sufficient flowrate of combustion supporting gas, in conjunction with the flowrates of primary and secondary combustion supporting gas, to procure total combustion of said solid fuel, a flame detector device, an igniter disposed in said refractory tap-hole or in said axial conduit, and translation means for said axial conduit whereby the length of said premix chamber may be adjusted.

The main burner advantageously comprises a first annular conduit for feeding secondary combustion supporting gas provided at its end with means for creating turbulence in the flow of combustion supporting gas and a second annular conduit for feeding secondary combustion supporting gas also provided with means for creating turbulence in the flow of combustion supporting gas. This burner is provided with means for adjusting the respective flowrates of the combustion supporting gases in the first and second annular conduits.

The facility for adjusting the premix chamber associated with the facility for adjusting the respective flowrates of the secondary combustion supporting gas in the first and second annular conduits enable the burner to continue to operate correctly when the flowrate and/or quality of the pulverized solid fossil fuel varies.

Another facility provided by these adjustment means is the ability to feed the primary mixture with a relatively high concentration of pulverized fossil fuel.

The ignition and support burner in accordance with the invention preferably comprises a complementary igniter comprising one or more liquid or gaseous fuel injectors distributed around the wall of the tap-hole.

The invention further encompasses combustion chambers with main burners and ignition and support burners using pulverized fossil fuel.

For a so-called tangential heating combustion chamber, in which the axes of the main burners are tangential to a cylinder coaxial with the hearth, each ignition and support burner is disposed between two main burners, on the vertical line through them, or to the side of a main burner and level therewith, but in this case the third conduit for feeding tertiary combustion supporting gas is concentric with the tap-hole and surrounds it.

For a so-called front heating combustion chamber, in which the main burners are concentrated on one side of the hearth, or on two opposed sides, each ignition and support burner is on the axis of a main burner or located in the secondary combustion supporting gas feed thereof or laterally adjacent thereto, but in this case the third conduit for feeding tertiary combustion supporting gas is concentric with the tap-hole and surrounds it.

The tertiary combustion supporting gas of the ignition and support burner may also, of course, be fed in part through the main burner.

Other objects and advantages will appear from the following description of examples of the invention when considered in connection with the accompanying drawings and the novel features will be particularly pointed out in the appended claims.

DESCRIPTION OF THE PREFERRED EMBODIMENTS

In these embodiments the combustion supporting gas is air, for example.

Figure 1:
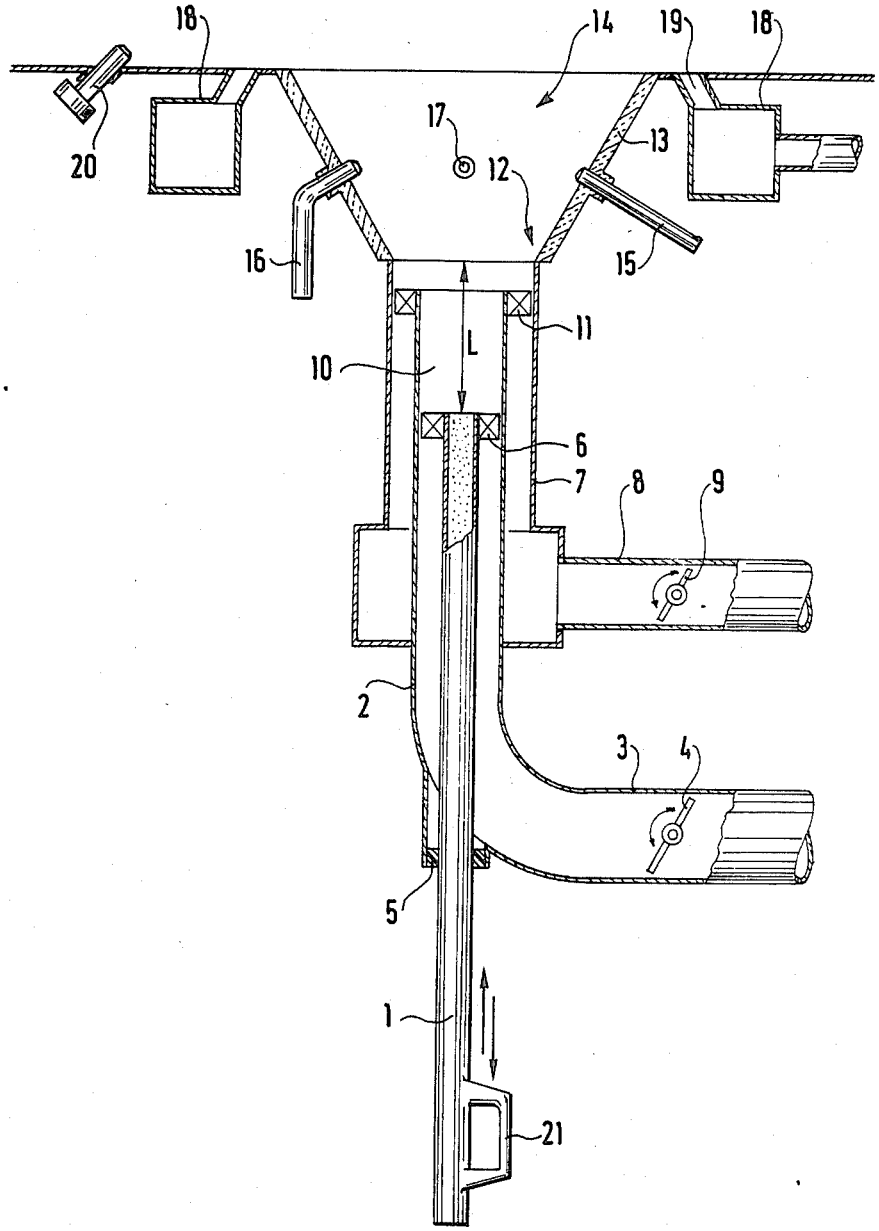
FIG. 1 shows an ignition and combustion supporting burner for pulverized coal.

In FIG. 1, the axial conduit or tube 1 provides a central feed of pulverized coal transported by primary air in a relatively dense phase (several kg of pulverized coal per kg of air, for example 4 to 10 kg of coal per kg of air).

This tube is surrounded by a first annular conduit or tube 2 feeding secondary air, originating from the conduit 3, the flowrate being adjustable by a shutter 4.

The axial tube 1 can slide within the annular tube 2 through the wall of which it passes by means of a seal 5 permitting movement in translation. Around the end of the tube 1 are provided vanes 6 for causing the secondary air from the annular tube 2 to rotate. These vanes 6 produce intimate mixing of the fuel and part of the air at the outlet from the tube 1, by creating turbulence. The air fed via the annular tube 2 may be pre-heated to favor ignition of the fuel.

The axial position of the end of the axial tube 1 is adjustable by means of a control handle 21 for moving this tube in translation, which enables the length L and consequently the volume of a premix chamber 10 between the end of the axial tube 1 and the bottom of the tap-hole 12 to be modified to match it to the flowrate and to the quality of the pulverized coal fed via the tube.

The second annular conduit or tube 7 feeding secondary air is fed by the conduit 8. It is equipped with a flowrate adjustment shutter 9 and at its end with rotation inducing vanes 11. The air fed through the annular tube may be pre-heated to favor ignition of the fuel.

The flowrates and proportions of air in the tubes 2 and 7 are adjusted to suit the quality of the coal.

The tertiary air is fed around the outlet from the tap-hole 12 by the circular conduit 18 connected to a third annular conduit or tube 19 discharging into the combustion chamber 14.

The tap-hole itself is provided with a refractory lining 13. The tap-hole comprises a low-power igniter 15 (approximately 1% of the total burner power) which can operate on gas or domestic fuel oil. It may be replaced by an electric igniter in which an arc is periodically struck between electrodes.

In the example shown a complementary gas igniter is disposed in the tap-hole. It comprises a plurality of injectors such as 16 and 17 distributed over the wall of the tap-hole in the ignition area.

Its operation is controlled by a flame detector 20 which also monitors the pulverized fossil fuel flame.

In an experimental burner burning 110 kg/h of coal the respective flowrates were as follows:

| | |
|---|---|
| Primary air (tube 1) (4 to 10 kg of carbon per kg of air) | 15–30 kg/h |
| First secondary air (tube 2) at 20 to 300° C. | 50–300 kg/h |
| Second secondary air (tube 7) at 20 to 300° C. | 50–300 kg/h |
| Tertiary air (conduit 18) at 20 to 300° C. | 0–1 300 kg/h |

The length of the premix chamber is adjustable between 100 and 500 mm according to how difficult it is to ignite.

Figure 2:
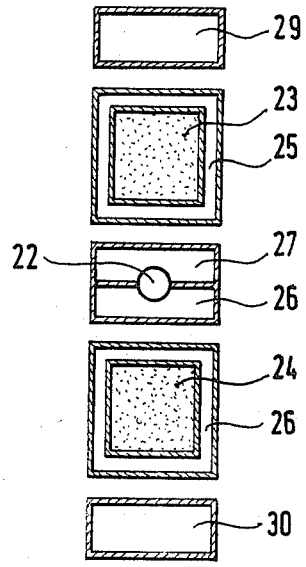
FIGS. 2 and 3 show two specific arrangements of an ignition and support burner relative to the main burners in the hearth of a tangential heating boiler.

FIG. 2 shows one arrangement of an ignition and support burner relative to the main burners in the case of a tangential heating boiler hearth. The ignition and support burner 22 is disposed between two main burners 23, 24 of rectangular cross-section each of which is surrounded by a rectangular opening 25, 26 for feeding secondary air and located between two rectangular orifices (27, 29; 28, 30) for feeding secondary air.

The orifices 27, 28 serve simultaneously to feed secondary air to the main burner and tertiary air to the ignition and support burner. In an arrangement of this kind the feeds 18, 19 shown in FIG. 1 are eliminated.

Figure 3:
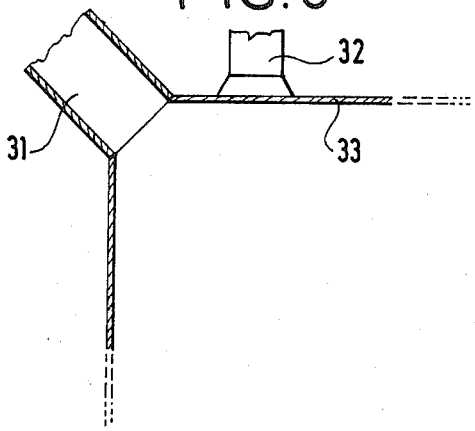

FIG. 3 shows another possible arrangement of the ignition and support burners relative to the main burners in a tangential heating boiler hearth. The main burner 31 is disposed at one corner of the hearth, which is of rectangular transverse cross-section. The ignition and support burner 32 is disposed to the side, on the side 33 of the hearth adjacent this corner, in a circular opening obtained by deforming at this point the tubes constituting the wall of the hearth. In this case, the ignition and support burner is the same as in FIG. 1.

Figure 4:
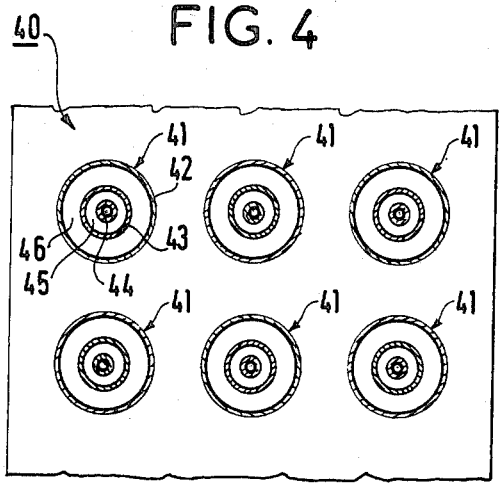
FIGS. 4, 5 and 6 show three specific arrangements of the ignition and support burners relative to the main burners in the hearth of a front heating boiler.

FIG. 4 shows a relative arrangement of the main and ignition and support burners in a front heating boiler hearth.

The main burners 41 are arranged in two rows on the side 40. They comprise an outer tube 42 and an inner tube 43 which delimit a central feed 45 of primary air and a peripheral feed 46 of secondary air. The ignition and support burners 44 are disposed on the axes of the main burners 41. These ignition and support burners 44 are the same as in FIG. 1, but in this case the tertiary air feeds 18, 19 are eliminated.

Figure 5:
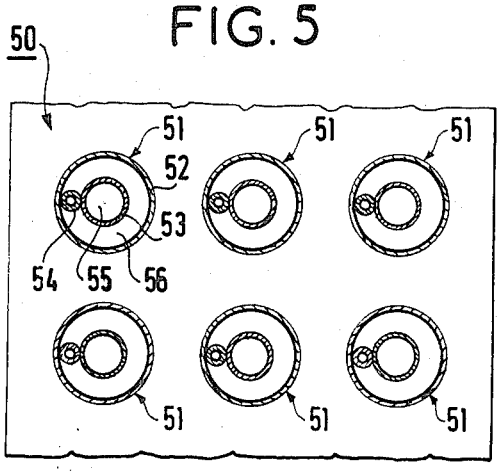

FIG. 5 shows another possible arrangement.

The main burners 51 are arranged in two rows on the side 50. They comprise an outer tube 52 and an inner tube 53 which delimit a central feed 55 for primary air and a peripheral feed 56 for secondary air. The ignition and support burners 54 are disposed in the secondary air feed of the main burners 51. In this case also the tertiary air feeds 18, 19 of the ignition and support burners 54 are eliminated.

Figure 6:
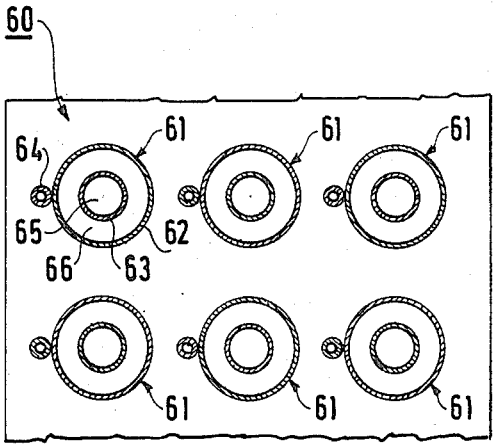

FIG. 6 shows another possible arrangement.

The burners 61 are arranged in two rows on the side 60. They comprise an outer tube 62 and an inner tube 63 which delimit a central feed 65 for primary air and a peripheral feed 66 for secondary air. Each of the ignition and support burners 64 is adjacent one main burner 61. In this case the ignition and support burners 64 are the same as in FIG. 1.

It will be understood that various changes in the details, materials and arrangements of parts which have been herein described and illustrated in order to explain the nature of the invention may be made by those skilled in the art within the principle and scope of the invention as expressed in the appended claims.

For example, without departing from the scope of the invention, the ignition and support burners may be fed with the same coal as the main burners or with coal of a different kind and/or particle size.

These ignition and support burners may be operated independently of the main burners. The invention is also applicable to burners or hearths burning lignite.

There is claimed:

1. Ignition and combustion supporting burner for pulverized solid fossil fuel, comprising an axial conduit (1) for feeding pulverized solid fuel in a primary combustion supporting gas, a refractory tap-hole (12) coaxially of said axial conduit having an inlet and a shape which confines the initial part of the flame, a premix chamber (10) between the end of said axial conduit and the inlet of said tap-hole for preliminary mixing of said fuel and a part of a secondary combustion supporting gas, a first annular conduit (2) feeding a part of a secondary combustion supporting gas, rotation inducing vanes (6) around the end of said axial conduit and within said first annular conduit for creating turbulence in the flow of said secondary combustion supporting gas within said first annular conduit, a second annular conduit (7) concentric about said first annular conduit (2) feeding another part of said secondary combustion supporting gas, rotation inducing vanes (11) at the end of said first annular conduit and within said second annular conduit for creating turbulence in the flow of said another part of said secondary combustion supporting gas, means (4, 9), separate from said rotation inducing vanes (6, 11) for independently adjusting the respective flowrates of said secondary combustion supporting gas in said first and second annular conduits respectively, a conduit (19) for feeding a tertiary combustion supporting gas concentric with said tap-hole and at least partially surrounding it, adapted to be supplied with a sufficient flowrate of a tertiary combustion supporting gas and acting, in conjunction with flowrates of said primary and secondary combustion supporting gas, to produce total combustion of said pulverized solid fossil fuel, a flame detector device (20), an igniter (15) disposed in one of said refractory tap-hole and said axial conduit, and translation means (21) for shifting said axial conduit axially within said first annular conduit (2) whereby the length of said premix chamber may be adjusted.

2. Ignition and combustion supporting burner according to claim 1, further comprising a complementary igniter consisting of one or more liquid or gas fuel injectors distributed around the wall of the tap-hole.

* * * * *